US005611085A

United States Patent [19]

Rasmussen

[11] Patent Number: 5,611,085

[45] Date of Patent: Mar. 18, 1997

[54] GARMENT FOR HOLDING AN ELECTROCARDIOGRAPHIC MONITORING UNIT AND CABLES

[76] Inventor: Verner Rasmussen, Skovalleen 14, DK-2880 Bagsbaerd, Denmark

[21] Appl. No.: 424,432

[22] PCT Filed: Nov. 2, 1993

[86] PCT No.: PCT/DK93/00353

§ 371 Date: Jun. 16, 1995

§ 102(e) Date: Jun. 16, 1995

[87] PCT Pub. No.: WO94/09655

PCT Pub. Date: May 11, 1994

[30] Foreign Application Priority Data

Nov. 2, 1992 [DK] Denmark ..... 1334/92

[51] Int. Cl.[6] ..... A41D 1/04; A41D 13/12

[52] U.S. Cl. ..... 2/102; 2/94; 128/644

[58] Field of Search ..... 2/94, 108, 102, 2/247, 250, 51, 96, 114, 106; 128/644, 639, 696; 607/108; 224/230, 673, 660, 663, 674

[56] References Cited

U.S. PATENT DOCUMENTS

| | | | |
|---|---|---|---|
| 2,620,479 | 12/1952 | Buck | 2/94 |
| 3,105,241 | 10/1963 | Allen | 2/94 |
| 3,409,007 | 11/1968 | Fuller | 128/644 |
| 3,534,727 | 10/1970 | Roman . | |
| 4,055,855 | 11/1977 | Ragone et al. | 2/114 |
| 4,601,067 | 7/1986 | Buonassissi | 2/94 |
| 4,637,075 | 1/1987 | Ingrisano et al. | 2/94 |
| 4,698,848 | 10/1987 | Buckley | 2/114 |
| 4,876,724 | 10/1989 | Susuki | 2/94 |
| 5,075,900 | 12/1991 | Chittenden | 2/94 |
| 5,111,818 | 5/1992 | Suzuki et al. | 128/644 |
| 5,211,321 | 5/1993 | Rodriguez | 2/94 |
| 5,224,479 | 7/1993 | Sekine | 128/644 |
| 5,247,707 | 9/1993 | Parker et al. | 2/94 |
| 5,353,793 | 10/1994 | Bornn | 128/644 |

*Primary Examiner*—Amy B. Vanatta

*Attorney, Agent, or Firm*—Dennison, Meserole, Pollack & Scheiner

[57] ABSTRACT

A garment for use in current registration of electrocardiographic measurements or similar measurements on a person wearing the garment by a portable monitoring unit, with wires and cables connected to electrodes adapted to be secured in contact with the skin of the wearer, the garment comprising a jacket containing at least one pocket placed under one armhole, in which pocket the monitoring unit is placed, the jacket comprising two front portions which can be mutually connected with a closure. In order to make the garment more comfortable to wear and to make it possible to mount cables and registration equipment before the wearer puts on the garment, at least one front portion includes a number of fixation devices placed approximately in line and mutually spaced, as well as a corresponding number of slits placed approximately in a line close to the closure.

10 Claims, 3 Drawing Sheets

GARMENT FOR HOLDING AN ELECTROCARDIOGRAPHIC MONITORING UNIT AND CABLES

BACKGROUND OF THE INVENTION

The present invention relates to a garment for use in current registration of electrocardiographic measurements on a person wherein at least one front portion includes devices for holding a monitoring unit and associated cables.

Garments for holding a monitor for current registration of electrocardiographic measurements or the arterial pressure of the wearer are known. The garments can be divided into two groups, one comprising tight-fitting jackets which in addition to holding the monitor also fixate the electrodes to the skin of the bearer. Generally, these jackets are considered uncomfortable, but the fixed connection between the electrodes and the jacket entails the advantage that the path of the cables between the electrodes and the monitor can be predetermined, as no movement will take place between the jacket and the electrodes.

U.S. Pat. No. 4,698,848 discloses a loose-fitting garment in form of a blouse with an internal pocket, in which the equipment for the current registration can be placed. The electrodes are attached to the skin in a conventional way and connected with cables transmitting the signals to the monitoring equipment. To give the bearer an adequate freedom of movement the cables are to have a certain excess length. This excess of length are often attached to the skin of the bearer by means of a self-adhesive band-aid. This is, however, a solution which is both fairly uncomfortable and which makes the placing of the electrodes and the establishing of the connection between the electrodes and the monitoring unit complicated, when the bearer is to put the garment on.

OBJECT OF THE INVENTION

The object of the invention is to provide a garment for use in current registration of electrocardiographic measurements and by means of which the above drawbacks have been considerably reduced.

This object is achieved by providing a garment in the form of a loosely fitting jacket comprising two front portions with at least one outside pocket for insertion of a monitoring unit, at least a plurality of devices for fixing cables and slits for enabling cables to pass from outside to inside.

SUMMARY OF THE INVENTION

It is conventional to use 4–5 electrodes in a current registration, which means that a corresponding number of cables are to be connected to the electrodes and the monitoring unit. In the garment according to the invention the cables are taken the shortest way from the electrode through one of the slits to each of the fixation means, to which the excess of cable length is fastened, and from there the cables are taken to the monitoring unit. As the cables do not need fastening to the bearer in other places than at the terminal of the electrode it is possible, and in many cases practical, to lay out the cables while the garment is placed on a so-called dummy, which means that the bearer is not inconvenienced during the fitting, but solely has to put on the assembled garment and therefore only has to put up with cable the connection of the electrodes already attached to the skin of the bearer.

According to the invention it is preferred that the pocket or the pockets is/are placed on the outer side of the garment. Thereby, the major part of the laying out of the cables will take place on the outer side of the garment, where there is no contact with the skin of the bearer.

It is advantageous according to the invention that a flap is mounted along the fixation means by use of a flap the coiled cables can be covered after the mounting, and by means of which they are protected against being inadvertently torn out of the fixation means.

The fixation means can according to the invention advantageously be designed as a ribbon connected at one end to the front portion and Velcro tape. Such a design gives good adaptation possibilities and is comfortable to handle. Furthermore, the garment is washable, the hygienic requirements for re-use being thus met. The flap can in closed condition be fixed with Velcro tape.

The laying out of the cables is simplified, if the flap, where it is fastened, is provided with a slit, through which the cables may be taken from the fixation means to the monitoring unit.

According to a preferred embodiment of the invention both front pieces are provided with fixation means and possibly with a flap, a pocket being also provided at each side for a monitoring unit. Thus, it becomes possible to perform two registrations simultaneously, for instance an electrocardiographic registration and a-registration of the arterial pressure.

DETAILED DESCRIPTION OF THE DRAWINGS

Figure 1:
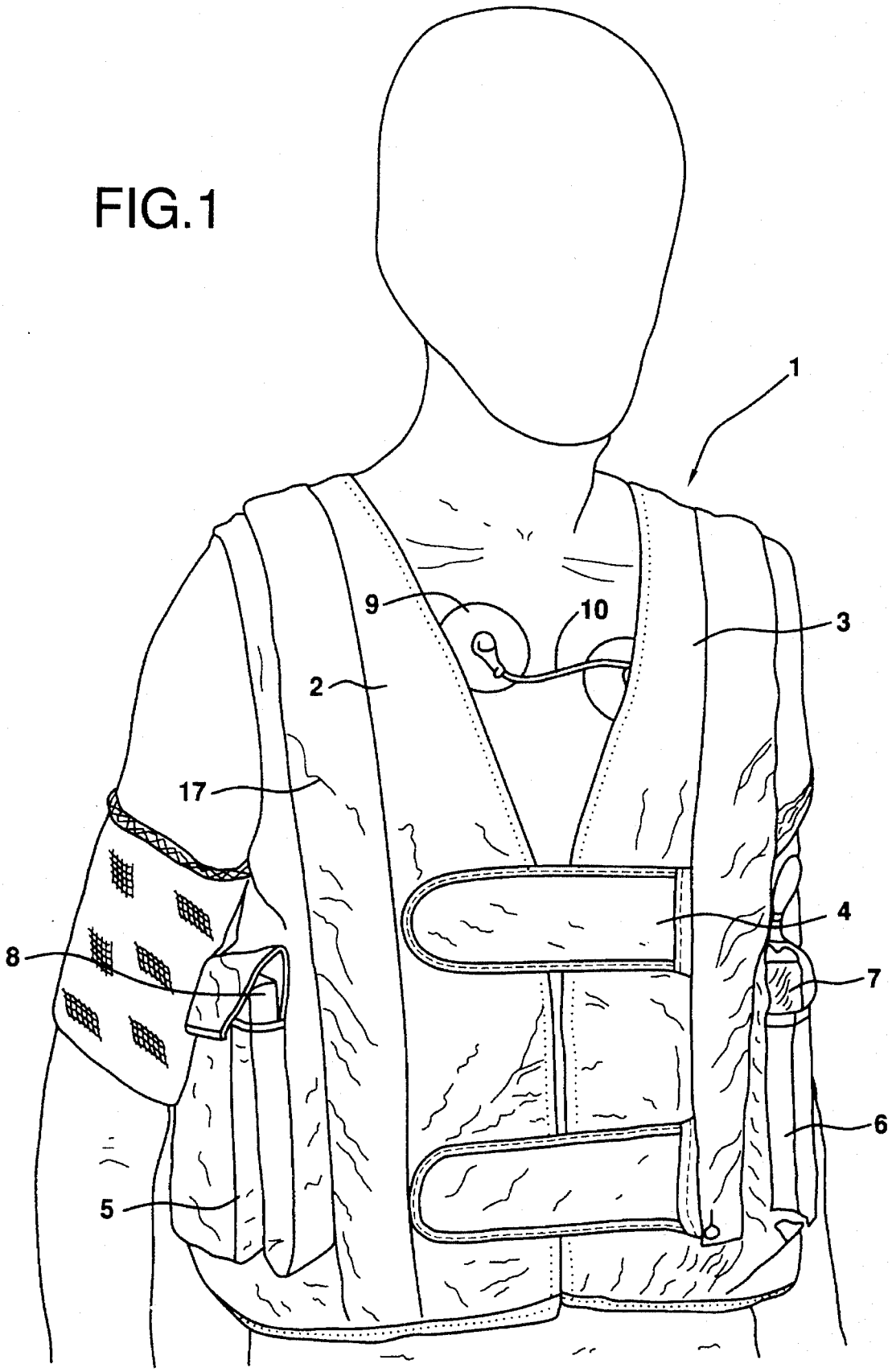
FIG. 1 shows a garment according to the invention worn by a person, the cardiac function of which is to monitored.
Figure 2:
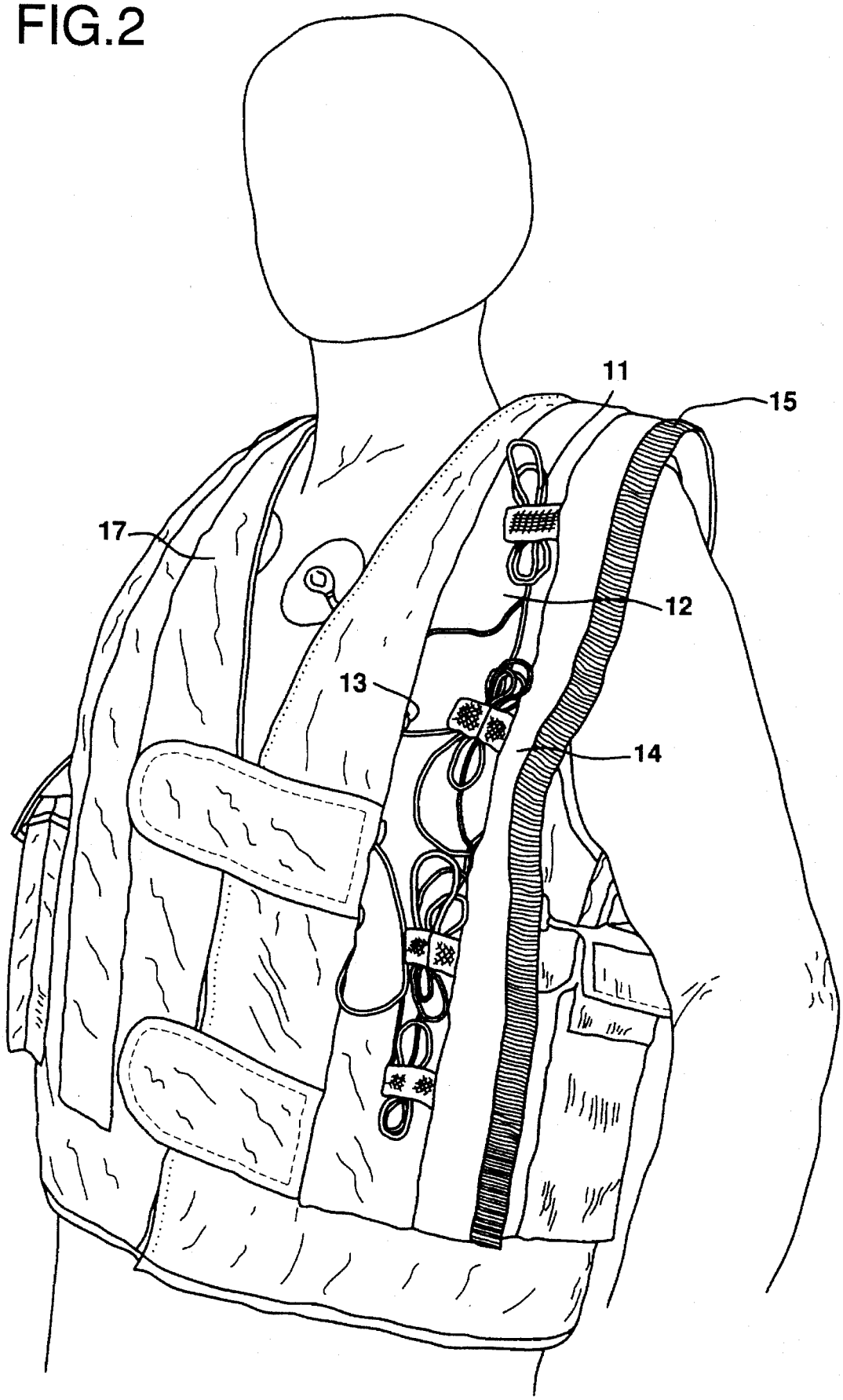
FIG. 2 shows the garment from another angle and with a flap for covering a row of fixation means, shown in its open position.
Figure 3:
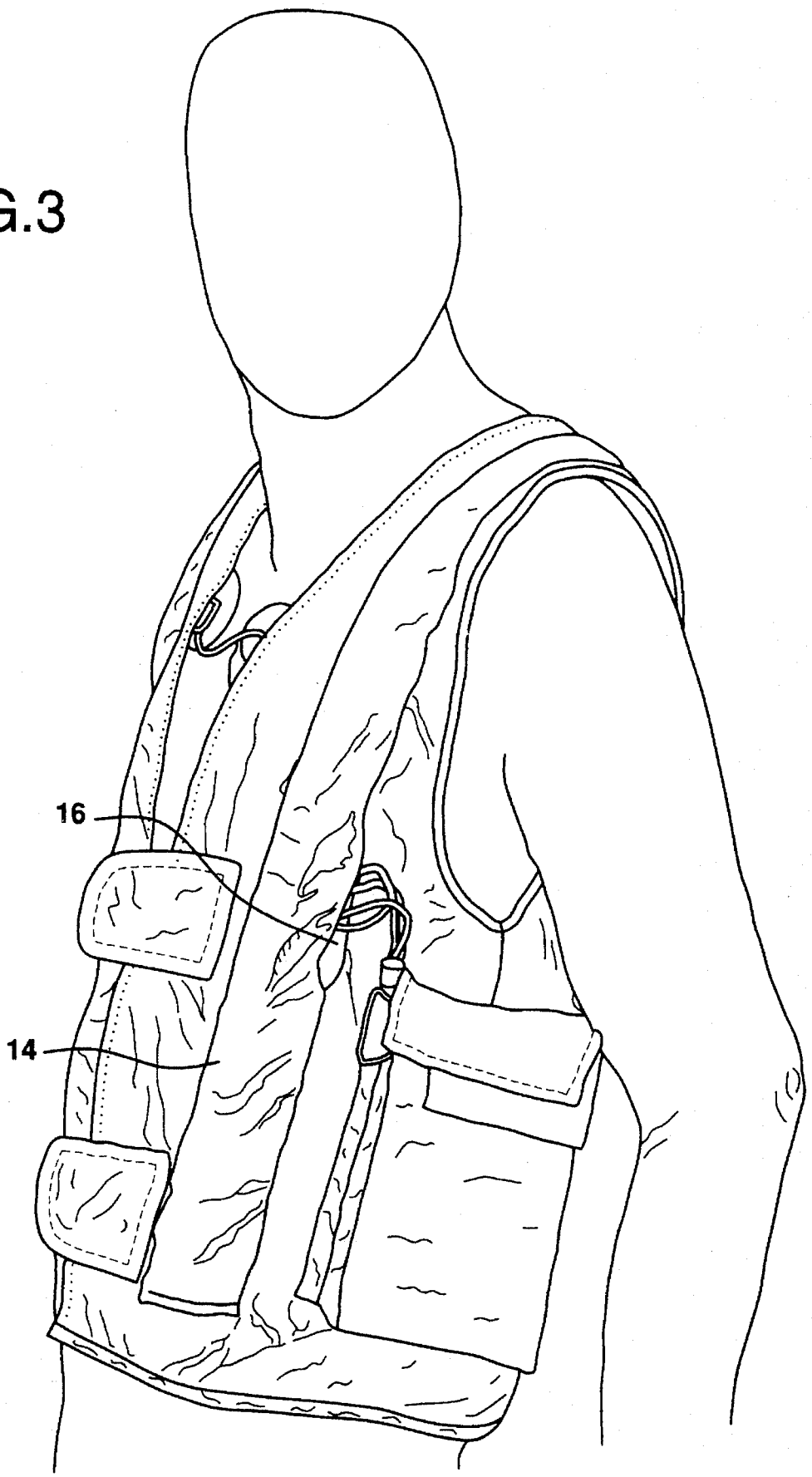
FIG. 3 shows the garment seen from the same angle as in FIG. 2 with the flap in its closed condition.

The garment 1 shown in FIGS. 1–3 is designed as a jacket without sleeves and having two front portions 2 and 3 to be connected by means of a closure 4. The closure 4 may be designed as lobes fastened to one front piece 3, and to be connected to the second one 2 by hook and loop fastening means, such as Velcro. Velcro tapes are generally preferred to buttons, as it makes it easier to adjust the jacket to different wearers. Moreover, the jacket comprises two pockets 5 and 6 placed approximately under the two arm holes. The pockets are sufficiently deep and wide for holding a monitoring unit 7,8 of the type used in current registration of the cardiac function of a human being for instance through 24 hours, or of the type, which in a similar way registers the arterial pressure over a longer period. For use in the current registration a number of electrodes 9 are attached to the chest of the person, the cardial function of whom is to be cardiographically monitored. These electrodes are secured to the skin by gluing in a conventional way. By means of cables 10 the electrodes are connected with the monitoring unit 7.

The cables 10 have out of regard for the freedom of movement of the person to be monitored a certain excess length. This excess of length is in practice a problem, which has up till now been solved by coiling the excess cable and attaching it to the skin of the wearer by means of a band-aid.

This method did not influence the monitoring, but was inconvenient for the person to be monitored. According to the invention these problems are eliminated. On the front side of the jacket 1, as shown in FIG. 2, a number of fixation means 11 is mounted, by means of which the excess of Cable can be placed and fastened in a place, where it is not inconvenient. The fixation means are placed in a row in an area 12 running lengthwise to the front pieces 2 and 3. The number of fixation means are at least to correspond to the number of electrodes to be connected, i.e. normally four or five for a cardiographic registration. Along the edge of the area 12 slits 13 may for instance be provided opposite each of the fixation means 11, through which slits the cables may be pulled from the inner side of the jacket to the outer side thereof. However, it may be advantageous provide with more slits than fixation means, whereby more alternatives in respect of the laying out of the cables are attained in order to secure an adequate direct run which can assure the required freedom of movement and minimize the risk of the cables loosening at the terminals fastened to the electrodes. The fixation means may for instance be short ribbons, which are free at one end and provided with a Velcro tape, by means of which they may be fastened to the surface of the area 12, which is covered by a textile cooperating with the Velcro tape. The fixation means may also be designed in other ways and may for instance comprise a pair of ribbons which can be bound by means of an adequate releasable knot. When the cables are positioned, the area 12 may be covered by a flap 14 fastened to the front piece 3 along the edge of the area 12. The flap is provided with a Velcro tape 15, by means of which it is secured against the area 12 in closed condition as shown in FIG. 3. In order to allow for passage of the cables, the flap may at the fastening edge be provided with a slit 16.

When the jacket 1 is used in practice, it is placed on a dummy, while the cables are laid out and the monitoring equipment is placed in the pocket 6. The cables 10 with the terminals are pulled into the inner side of the jacket with a suitable free length. The person, whose cardiac function is to be examined, has in the meantime been equipped with the electrodes, and when this has happened, the assembled jacket 1 is put on the person, so that only the cable terminals need to be connected to the electrodes. The other portion of the jacket a similar arrangement may be provided, in which the fixation means are covered by a flap 17. The arrangement of the fixation means in a line is so universal that it may also be used when attaching and adapting other monitoring equipment, for instance for current registration of arterial pressure. The equipment for performing the cardiographic registrations may thus be held in one side of the jacket, while the equipment for registration of the arterial pressure may be held in the other side thereof.

The jacket 1 excells in being able to be subjected to the usual washing and maintenance routines for re-usable hospital equipment. It makes it comparatively easy to carry the required registration equipment used during the monitoring, and it minimizes time consumption and the inconvenience in securing the electrodes. Moreover, the coiled cables are protected by the flaps 14, 17, the risk of their falling off during the period of registration being minimized.

I claim:

1. A portable measuring unit holding garment for use on a person whose cardiographic measurement needs to be registered, wherein the measuring unit includes electrodes to be secured in contact with the skin of the person, a portable monitor having cables with terminals for attachment to the electrodes, said garment comprising:

a sleeveless jacket with armholes forming first and second front portions, a first pocket at the first front portion outside positioned substantially below an armhole for placement of a first monitor;

means for closing said first and second front portions;

a plurality of fixation means on an outside area of said first front portion; and a plurality of slits in said first front portion, each of said slits for passing a monitor cable from the front portion outside to the inside.

2. The garment according to claim 1, wherein the fixation means comprise a short ribbon having one end fixed to said first front portion and a free end which is attached with a hook and loop fastening device.

3. The garment according to claim 1, wherein the fixation means comprise a pair of ribbons with one end fixed and the other end for tying a releasable knot.

4. The garment according to claim 1, further including a covering flap, said flap being fixed to the first front portion and along the fixation means and having a width such as to cover the fixation means when folded over the fixation means and held in position with a hook and loop fastening device.

5. The garment according to claim 1, wherein the means for closing the first and second front portions are in the form of lobes fastened to one of said first and second front portion and connected to the other front portion by a hook and loop fastening device.

6. The garment according to claim 2, further including a second pocket on the outside of said second front portion for placement of a second monitor.

7. The garment according to claim 6, further including a covering flap fixed to the second front portion having a width such as to cover additional fixation means which is present when a second monitor is employed.

8. A portable monitoring unit holding garment for use on a person having electrodes secured to the skin of the person, said garment comprising:

a sleeveless jacket with armholes forming first and second front portions;

a pocket on an outside of one of the front portions;

a monitor with cables and cable terminals, said monitor being placed in the pocket;

a plurality of fixation means each for holding some length of folded cable in position outside said one front portion;

means for covering said plurality of fixation means;

a plurality of slits, each slit for passing a cable with its terminal from the front portion outside to the inside, and means for closing said first and second front portions after the person has been covered with the garment and the cable terminals have been attached to the electrodes.

9. The portable measuring unit holding garment according to claim 8, wherein the monitor operates to register electrocardiographic measurements.

10. The portable measuring unit holding garment according to claim 8, wherein the monitor operates to register arterial pressure.

* * * * *